United States Patent [19]

Takabayashi et al.

[11] Patent Number: 4,723,468

[45] Date of Patent: Feb. 9, 1988

[54] ELECTRONIC STRINGED INSTRUMENT

[75] Inventors: Youjiro Takabayashi; Masahiro Ikuma; Takashi Norimatsu, all of Hamamatsu, Japan

[73] Assignee: Nippon Gakki Seizo Kabushiki Kaisha, Hamamatsu, Japan

[21] Appl. No.: 922,688

[22] Filed: Oct. 23, 1986

[30] Foreign Application Priority Data

Oct. 26, 1985 [JP] Japan ..... 60-240138
Mar. 25, 1986 [JP] Japan ..... 61-68947
Mar. 25, 1986 [JP] Japan ..... 61-45053[U]

[51] Int. Cl.[4] ..... G10H 3/18

[52] U.S. Cl. ..... 84/1.16; 367/147; 333/141; 73/597; 84/DIG. 30

[58] Field of Search ..... 84/1.16, 1.15, 1.01, 84/DIG. 30; 367/197; 333/141, 142; 73/597

[56] References Cited

U.S. PATENT DOCUMENTS 4,241,430 12/1980 Kayem et al. ..... 73/597
4,248,120 2/1981 Dickson ..... 333/141
4,584,676 4/1986 Newman ..... 73/597

*Primary Examiner*—S. J. Witkowski
*Assistant Examiner*—David S. Warren
*Attorney, Agent, or Firm*—Blakely, Sokoloff, Taylor & Zafman

[57] ABSTRACT

An electronic stringed instrument includes strings, a plurality of metal frets, an ultrasonic transmitter/-receiver, and a fret discriminator. The strings are kept taut above an instrument body. The frets are arranged below the strings along their extension direction. When a player depresses a given string to be picked, at least one of the metal frets is brought into contact with the given string. The transmitter/receiver is coupled to specified positions of the strings and causes ultrasonic vibrations of the strings and receives an echo vibration generated as a reflection of the ultrasonic vibration at a fret contacting the given string. The fret discriminator discriminates the fret contacting the string among the metal frets according to the time difference between the generation of the ultrasonic vibration and the receipt of the echo vibration by the transmitter/receiver.

19 Claims, 31 Drawing Figures

P1
S1
S2
C1
S3
P2
P3
P4
t1
t2
t3
TIME

ELECTRONIC STRINGED INSTRUMENT

BACKGROUND OF THE INVENTION

The present invention relates to an electronic stringed instrument.

In an electronic stringed instrument, it is necessary that a fret position of a given string depressed by a player's finger is discriminated to specify a pitch of a musical tone to be produced, and at the same time, a picking timing is detected to determine timings of sounding of the musical tone.

A conventional method of detecting a fret position in the process for producing musical tones in such an electronic stringed instrument will be described with reference to FIG. 1. When a player depresses a string 1 with his finger at a desired position on a fingerboard so as to generate a specific musical tone, the string 1 is brought into contact with the specific fret and the length of the string 1 to be picked is determined. However, according to the conventional method, at this moment, the fret position is not discriminated. The fret position is discriminated after the player picks the string 1. More specifically, when the string 1 is picked, the string 1 vibrates in a period corresponding to the string length. The vibrations of the string 1 are converted by an electromagnetic pickup 2 into an electrical signal having a waveshape similar to the vibrations of the string 1. This electrical signal is waveshaped by a low-pass filter 3. A peak detector 4 detects the peak in amplitude of the waveshaped signal. A pulse converter 5 generates pulses in synchronism with the detection result of the peak detector 4. A pulse interval measuring circuit 6 measures an interval of pulses generated in synchronism with peak detection. The pulse interval measuring circuit 6 generates a digital signal corresponding to the pulse interval. A value represented by this digital signal corresponds to the fundamental frequency of the string 1 and also represents the position of the fret which which the string 1 is in contact. A tone generator 7 generates a musical tone signal on the basis of this digital signal. A sound system 8 produces a musical tone represented by the musical tone signal.

In the conventional arrangement described above, the position of the fret with which the string 1 is in contact is detected on the basis of the period of vibration of the picked string 1. At least a period corresponding to a possible maximum vibration period of the string 1 must be preset for detecting the peak. For example, a period of about 1/80 second is required for a typical six-string guitar. In addition, the vibrations of the string 1 immediately after picking have a large harmonic overtone component ratio, and this ratio causes variations in peak. Therefore, the initial peak is not used for discriminating the fret position, and the fret position is detected according to the second or subsequent peak at which the harmonic overtone component ratio is rapidly reduced. In the conventional arrangement, it takes a relatively long period of time until a musical tone is produced by the sound system after the player picks the string 1. The player experiences an unnatural feeling.

In an electronic stringed instrument having a plurality of strings 1, the vibration of the strings 1 are converted into electrical signals by electromagnetic pickups respectively corresponding to the strings 1. A magnetic field formed by each electromagnetic pickup 2 is adversely affected by not only the string 1 assigned thereto but also by adjacent strings. The fret position may therefore be erroneously discriminated.

SUMMARY OF THE INVENTION

It is, therefore, an object of the present invention to provide an electronic stringed instrument for accurately detecting a position of a fret with which a string depressed by a player's finger is in contact.

It is another object of the present invention to provide an electronic stringed instrument having a short response time for producing a musical tone.

In order to achieve the above objects of the present invention, there is provided an electronic stringed instrument comprising: an instrument body; a string which is stretched above the instrument body; a plurality of metal frets which are provided on the instrument body and below the string so that a player's depression of the string causes contact between the string and one or ones of the plurality of metal frets; ultrasonic transmitting/receiving means, provided on the instrument body and coupled to a specific point of the string, for generating an ultrasonic wave so that the ultrasonic wave is propagated through the string toward the nearest fret to the specific point among the fret or frets contacting the string and for receiving an echo wave which is a reflected wave of the ultrasonic wave from the nearest fret; and fret discriminating means connected to the ultrasonic transmitting/receiving means for discriminating the nearest fret among the plurality of metal frets according to a time difference between generation of the ultrasonic wave and the receipt of the echo wave and for generating a fret signal representing the nearest fret.

The present invention is based on an assumption that a propagation time of an ultrasonic wave to be propagated through a string is proportional to a string length. An ultrasonic transmitting/receiving means intermittently transmits an ultrasonic wave. The ultrasonic wave propagates from one end to the other end of the string. When the player wishes to produce a specific musical tone and depresses a predetermined position of the string, the string is brought into contact with at least one of the plurality of frets so that a string length is defined by this fret. The ultrasonic wave propagating from one end to the other end of the string is reflected by the fret with which the string is in contact, and an echo is generated. The echo propagates from the fret to one end of the string and is received by the ultrasonic transmitting/receiving means. The fret discriminating means discriminates the fret position according to the ultrasonic wave intermittently transmitted from the ultrasonic transmitting/receiving means and the echo received thereto. Therefore, the time required for discriminating the fret is the ultrasonic propagation time for which the ultrasonic wave reciprocates between one end of the string and the fret with which this string is contact. The fret discrimination time is not associated with the string diameter. In addition, the speed of the ultrasonic wave propagating through a solid object is very high. The player normally depresses the string before picking it. Therefore, the musical tone can be produced substantially simultaneously with picking of the string, and the musical tone upon picking can be obtained in a short response time.

The ultrasonic wave propagates through the medium, unlike in the case of a magnetic field. The ultrasonic wave is attenuated upon propagation through the medium. Even if another ultrasonic source is located near the ultrasonic transmitting/receiving means, it is substantially free from the influence of an ultrasonic source nearby. Therefore, the fret discriminating means can accurately discriminate the fret position according to only the ultrasonic wave transmitted thereby and the echo derived from the transmitted ultrasonic wave.

DESCRIPTION OF THE PREFERRED EMBODIMENTS

Figure 1:
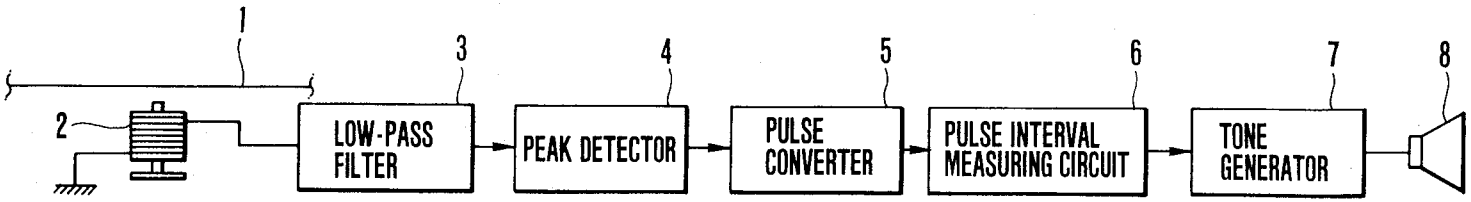
FIG. 1 PRIOR ART
FIG. 1 is a block diagram of a conventional fret discriminating means.
Figure 2:
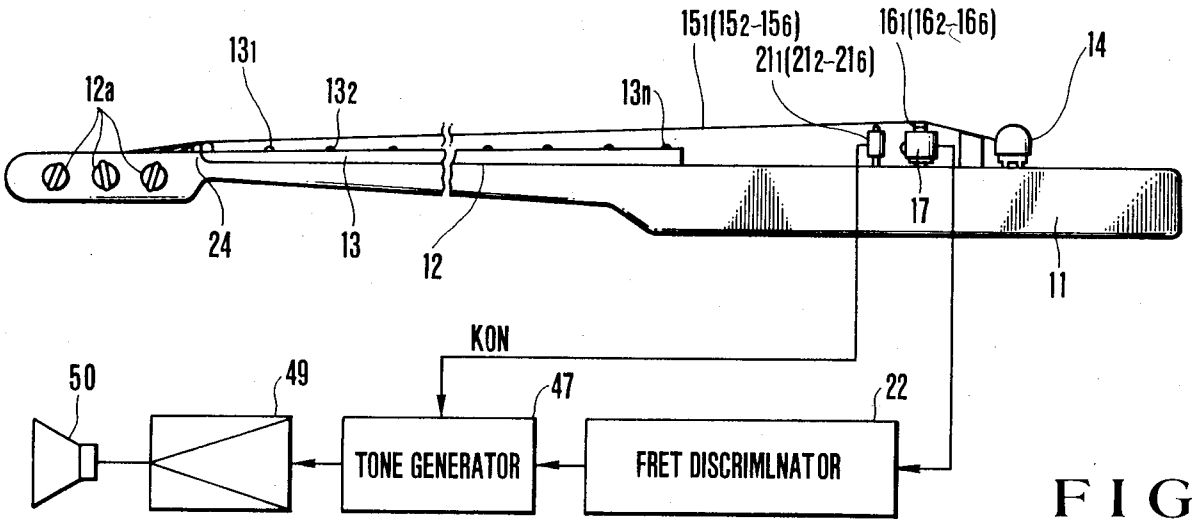
FIG. 2 is a schematic side view of an electronic stringed instrument according to an embodiment of the present invention.
Figure 3:
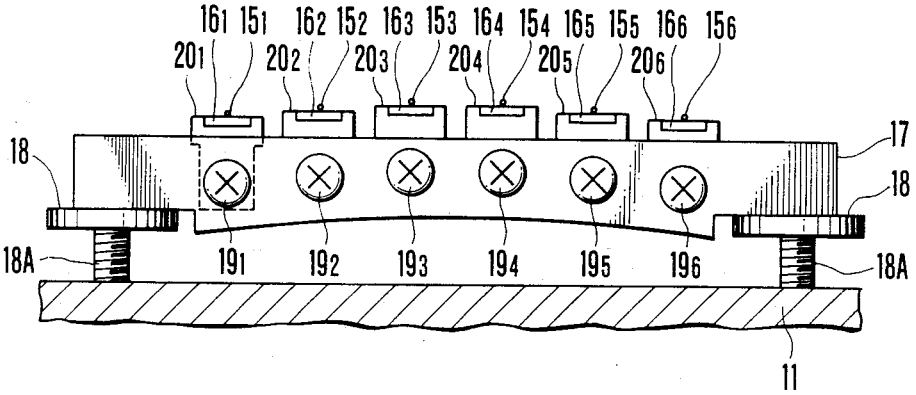
FIG. 3 is a front view showing a bridge holder of the stringed instrument in FIG. 1.
Figure 4:
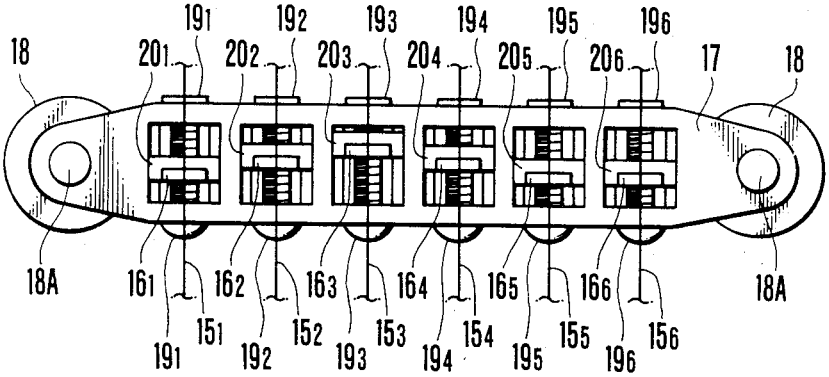
FIG. 4 is a plan view showing the bridge holder in FIG. 3.

FIG. 2 shows an embodiment wherein the present invention is applied to a six-string guitar. Referring to FIG. 2, reference numeral 11 denotes a guitar body. N metal frets $13_1$, $13_2$, . . . , $13_n$ are fixed on a fingerboard 130 in a direction perpendicular to the longitudinal direction of the fingerboard 130, and the fingerboard 130 is fixed on a neck 12 connected to the body 11. Bare steel strings $15_1$, $15_2$, . . . $15_6$ having different diameters are kept taut between tuning keys 12*a* fixed at the head at the distal end of the neck 12 and a tailpiece 14 extending on the body 11. Six ceramic piezoelectric elements $16_1$, $16_2$, . . . $16_6$ as the ultrasonic transmitting/receiving means are separated from each other and mounted near the tailpiece 14. The strings $15_1$ to $15_6$ are respectively in contact with the piezoelectric elements $16_1$ to $16_6$. As is best shown in FIGS. 3 and 4, a pair of bolts 18A extend on the body 11 so as to cause a bridge holder 17 to be vertically movable. The bridge holder 17 is urged by the elastic forces of the strings $15_1$ to $15_6$ against nuts 18 threadably engaged with the pair of bolts 18A. In order to adjust the height of the bridge holder 17, the nuts 18 are turned. Holes each having a rectangular cross section are vertically formed from the upper surface of the bridge holder 17 and are spaced apart from each other at a predetermined pitch. Adjusting screws $19_1$, $19_2$, . . . $19_6$ extend parallel to the strings $15_1$, $15_2$, . . . $15_6$ through the holes. The heads of the adjusting screws $19_1$ to $19_6$ project from one side surface of the bridge holder 17 such that the screws $19_1$ to $19_6$ can be turned with a screwdriver. Bridges $20_1$, $20_2$, . . . $20_6$ carrying the piezoelectric elements $16_1$ to $16_6$ are threadably engaged with the adjusting screws $19_1$ to $19_6$ extending through the holes formed in the bridge holder 17. By turning the screws $19_1$ to $19_6$, the bridges $20_1$ to $20_6$ are moved parallel to the strings $15_1$ to $15_6$, respectively. The pivotal movement of the bridges $20_1$ to $20_6$ is defined by the edges of the holes in a direction parallel to the strings. Upon rotation of the adjusting screws $19_1$ to $19_6$, the bridges $20_1$ to $20_6$ can be moved within the above-mentioned range in the axial direction of the adjusting screws $19_1$ to $19_6$, i.e., the extending direction of the strings $15_1$ to $15_6$. A common damper 23 is arranged between the tailpiece 14 and the bridges $20_1$ to $20_6$. The damper 23 is made of rubber for absorbing vibrations of the strings. Electromagnetic pickups $21_1$, $21_2$, . . . $21_6$ are arranged between the piezoelectric elements $16_1$, $16_2$, . . . $16_6$ and the frets $13_1$, $13_2$, . . . $13_n$ fixed on the fingerboard 130 of the neck 12 so as to respectively correspond to the strings $15_1$, $15_2$, . . . $15_6$ (i.e., independently). The electromagnetic pickups $21_1$, $21_2$, . . . $21_6$ detect vibrations of the corresponding strings $15_1$, $15_2$, . . . $15_6$ picked by the player. As a result of the detection, each electromagnetic pickup supplies a picking signal KON to a tone generator 47. The piezoelectric elements $16_1$ to $16_6$ are connected to a fret discriminating means 22. A rubber damper 24 is arranged at the end of the fingerboard 130 near each key 12*a* to absorb the string vibrations when the string is not held on the fret.

Figure 5:
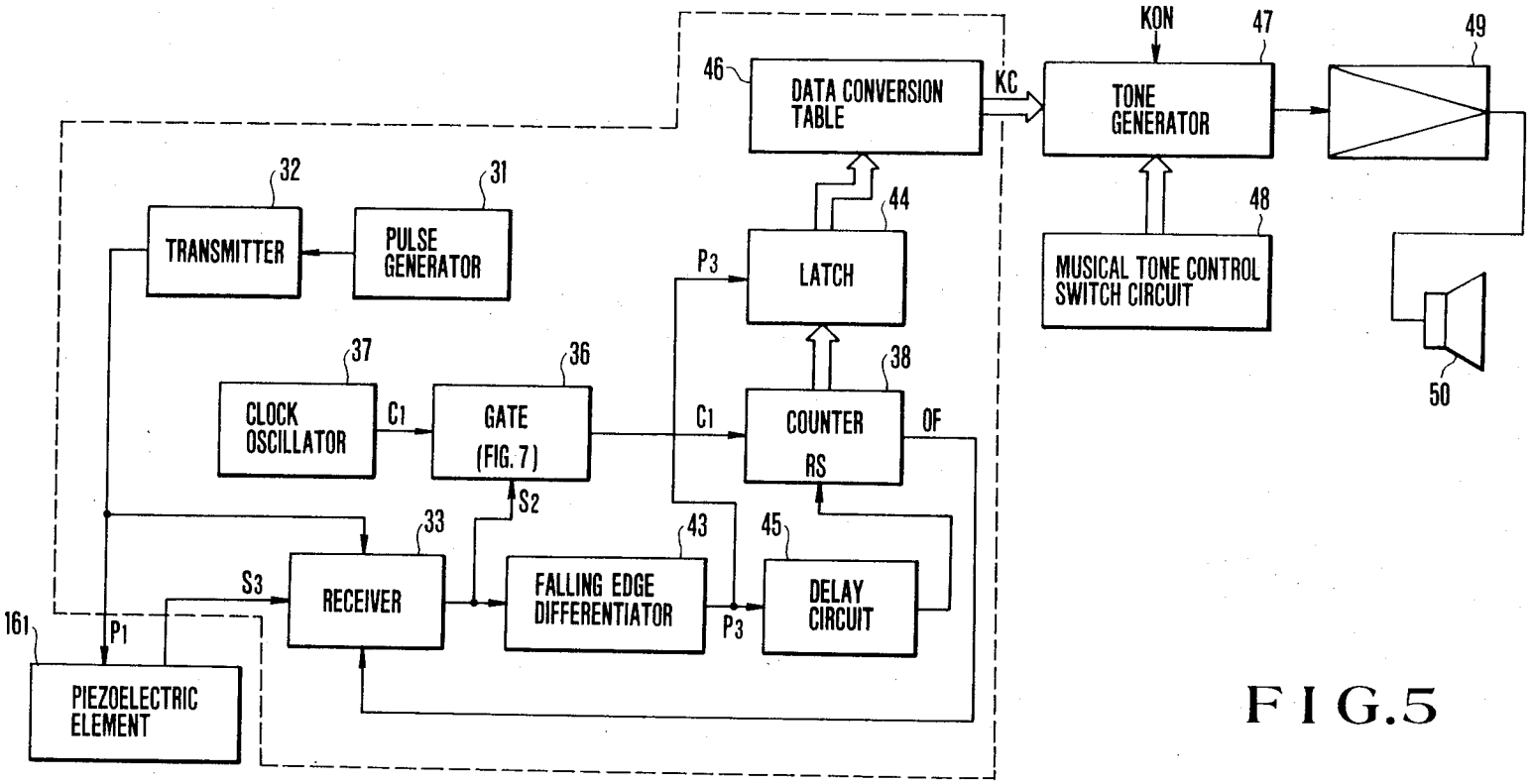
FIG. 5 is a block diagram of the stringed instrument in FIG. 1.
Figures 6A, 6B, 6C, 6D, 6E, 6F, 6G, 6H, 6I:
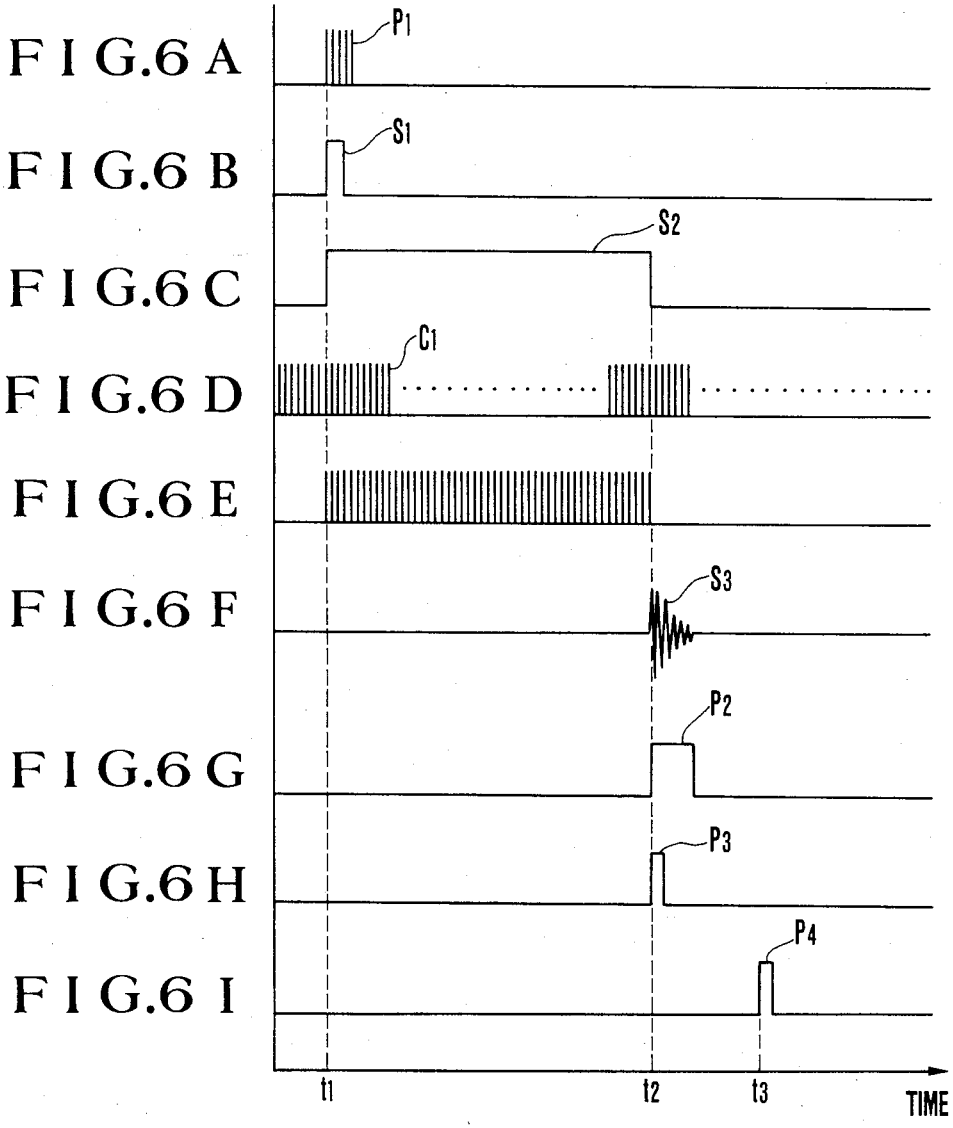
FIGS. 6A to 6I are timing charts for explaining the operation of the stringed instrument in FIG. 1.
Figure 7:
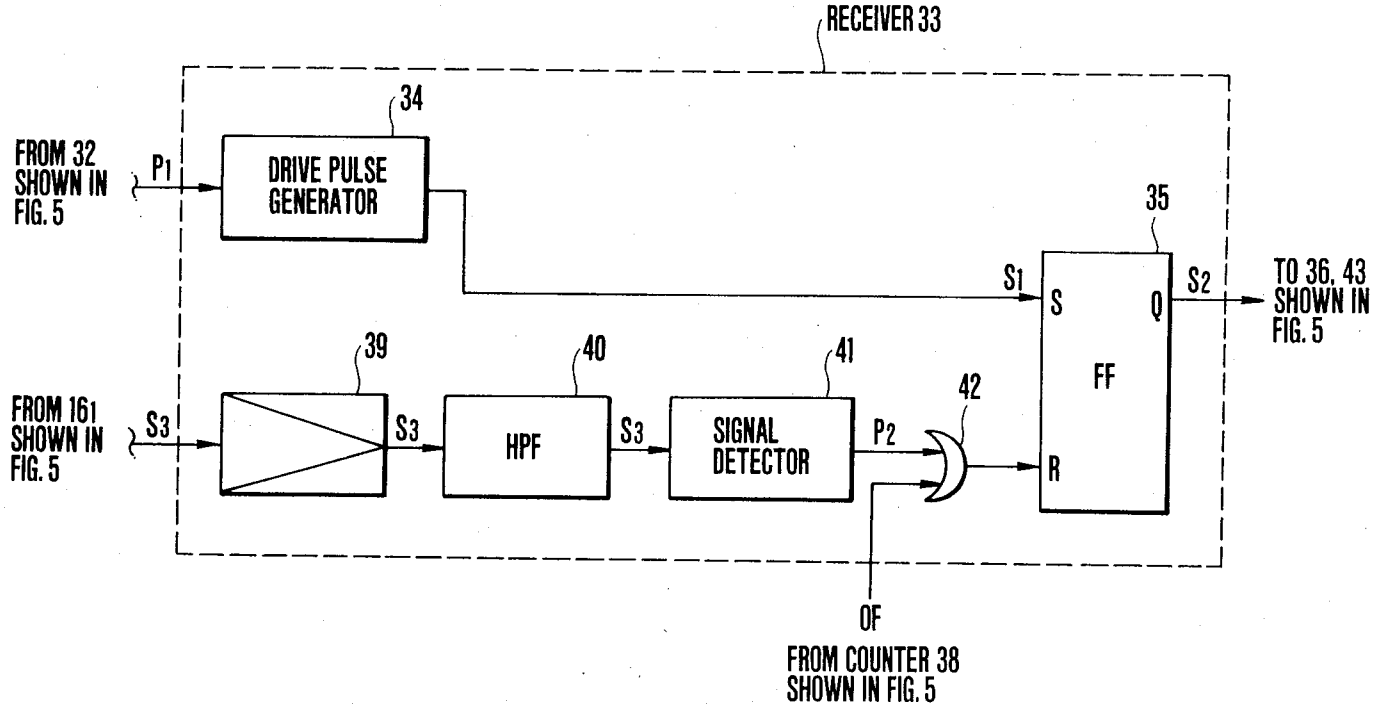
FIG. 7 is a block diagram of a receiver in FIG. 5.

The electrical circuit connected to the piezoelectric elements $16_1$ to $16_6$ and the electromagnetic pickups $21_1$ to $21_6$ will be described with reference to FIGS. 5 to 7. The electrical circuit in FIGS. 5 to 7 is arranged for each one of the strings $15_1$ to $15_6$. In the following description, one (associated with the string $15_1$) of the electrical circuits will be exemplified. Predetermined RF pulses (or pulses including the RF wave) P1 are generated by a pulse generator 31 at an interval of 3 to 10 msec. The RF pulses are applied from a transmitter 32 to the piezoelectric element $16_1$ (time t1 in FIG. 6A). The piezoelectric element $16_1$ generates an ultrasonic wave having a frequency of 400 kHz to 1 MHz (in the case of bare wires). The ultrasonic wave propagates through the string $15_1$. When the player wishes a specific musical tone to depress the string $15_1$ at a predetermined position of the neck 12, the string is brought into contact with at least one of the frets $13_1$ to $13_n$ according to the depression position of the string $15_1$. The ultrasonic wave is reflected by one of the metal frets $13_1$ to $13_n$ which is in contact with the string $15_1$, so that an echo is generated.

Prior to generation of the echo, when the RF pulse P1 is generated, a drive pulse generator 34 in a receiver 33 in FIG. 7 supplies a set signal S1 to a set terminal S of an RS flip-flop 35 (FIG. 6B). The RS flip-flop 35 supplies a gate enable signal S2 to a gate 36 (FIG. 6C) to open the gate 36. An output from a clock generator 37 for generating a clock signal C1 (FIG. 6D) is supplied as an output (FIG. 6E) of the gate 36 to a counter 38 while the gate enable signal S2 is supplied to the gate 36 (FIG. 6E). The counter 38 counts pulses of the clock signal C1 supplied from the clock generator 37.

When the echo reaches the piezoelectric element $16_1$ at time t2, the piezoelectric element $16_1$ generates an electrical signal S3 (FIG. 6F) having a waveform similar to that of the echo. The electrical signal S3 is then supplied to the receiver 33. In the receiver 33, an amplifier 39A in FIG. 7 amplifies the electrical signal S3. When the player picks a string (as will be described later), a high-pass filter (HPF) 40 eliminates a low-frequency component caused by string vibrations from the electrical signal S3. Thereafter, a pulse signal P2 (FIG. 6G) which goes high during the ON duration of the echo in response to the electrical signal S3 is output from a signal detector 41. The signal P2 is supplied to a reset terminal R of the RS flip-flop 35 through an OR gate 42. As a result, the gate enable signal S2 supplied from the RF flip-flop 35 goes low (FIG. 6C). The gate 36 is disabled and the counter 38 stops counting the clocks. Therefore, the counter 38 stores the number of clocks output between time t1 and time t2 (FIG. 6E). A falling differentiator 43 generates a pulse signal P3 (FIG. 6H) which rises at the trailing edge of the gate enable signal S2. The count of the counter 38 is latched by a latch 44 in response to the pulse signal P3. The pulse signal P3 is also supplied to a delay circuit 45. At time t3 delayed from time t2 by a predetermined period of time, a delayed pulse P4 from the delay circuit 45 is supplied to a reset terminal RS of the counter 38, so that the counter 38 is ready for the next counting cycle. If the player does not depress the string $15_1$ at any position and then the echo is not generated, the counter 38 overflows. An overflow signal OF from the counter 38 is supplied to an OR gate 42 (FIG. 4) in the receiver 33 to reset the RS flip-flop 35.

The count of the counter 38 which is transferred to the latch 44 is converted into a key code signal KC by a data conversion table 46. The tone generator 47 specifies a pitch of a musical tone to be produced, according to the key code signal KC. When the electromagnetic pickup $21_1$ detects string picking and the picking signal KON upon its detection is supplied from the electromagnetic pickup 21 to the tone generator 47, a musical tone signal is generated according to the instruction from a musical tone control switch circuit 48 and is supplied to a sound system including an amplifier 49 and a loudspeaker 50. The sound system produces the musical tone having a pitch corresponding to the discriminated fret position.

According to this embodiment, the position of the fret with which one of the strings $15_1$ to $15_6$ is in contact is discriminated according to the propagation time of the ultrasonic wave through the corresponding one of the strings $15_1$ to $15_6$ regardless of the string vibrations upon picking. The position of the fret contacting one of the strings $15_1$ to $15_6$ is discriminated in an ultrasonic reciprocal propagation time between one of the piezoelectric elements $16_1$ to $16_6$ and one of the frets $13_1$ to $13_n$ which contacts the depressed string. In addition, since the fret position can be discriminated prior to picking, a musical tone having a pitch corresponding to the position of the fret contacting the string can be generated simultaneously when the player picks the string. The ultrasonic wave propagating through the strings $15_1$ to $15_6$ cannot be transferred to the piezoelectric elements $16_1$ to $16_6$ without being through the bridges $20_1$ to $20_6$, the adjusting screws $19_1$ to $19_6$, and the bridge holder 17, the ultrasonic wave is greatly attenuated. The piezoelectric elements $16_1$ to $16_6$ do not therefore receive the influence from the ultrasonic wave propagating through the adjacent strings $15_1$ to $15_6$.

Pitch data in place of the key code signal KC may be stored in the data conversion table 46 and may be supplied to the tone generator 47.

Figure 8:
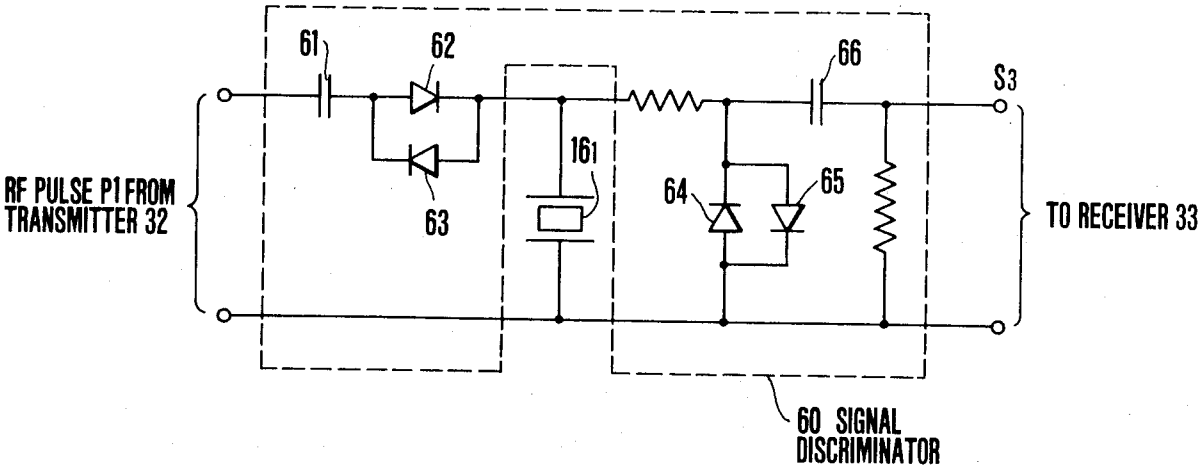
FIG. 8 is a block diagram showing a modification of a signal discriminator in the stringed instrument in FIG. 1.

The dynamic range (e.g., 10 V) of the RF pulse P1 applied from the transmitter 32 to the piezoelectric element $16_1$ greatly differs from that (e.g., 0.6 V) of the electrical signal S3 based on the echo generated upon reflection of the ultrasonic wave by the fret. Therefore, separate discriminators may be arranged in the transmitter 32 and the receiver 33, respectively. Alternatively, a signal discriminator 60 shown in FIG. 8 may be arranged. More specifically, since the RF pulse P1 supplied from the transmitter 32 has a wide dynamic range, the DC component of the pulse P1 is removed by a capacitor 61, and the pulse P1 then passes through a pair of parallel diodes 62 and 63 reverse-biased with each other. The resultant pulse is then applied to the piezoelectric element $16_1$. Since the RF pulse P1 is also supplied through diodes 64 and 65, the pulse cannot be detected as the electrical signal S3 by the receiver 33. The electrical signal S3 generated by the piezoelectric element $16_1$ has a narrow dynamic range and does not pass through the diodes 64 and 65. The DC component of the signal S3 is eliminated by a capacitor 66, and the resultant pulse is supplied to the receiver 33. However, since the electrical circuit S3 does not pass through the diodes 62 and 63, it cannot be applied to the transmitter 32. Threshold levels of the diodes 62, 63, 64, and 65 fall within the range between the dynamic ranges of the RF pulse P1 and the electrical signal S3.

The pulse generator 31, the transmitter 32, the receiver 33, the gate 36, the clock generator 37, the counter 38, the falling differentiator 43, the latch 44, the delay circuit 45, and the data conversion table 46 are arranged for each one of the strings $15_1$ to $15_6$. However, the RF pulses P1 may be generated by a single pulse generator 31 and sequentially supplied to the piezoelectric elements $16_1$ to $16_6$, and the echoes from the strings $15_1$ to $15_6$ may be processed by a single receiver 33, a single gate, a single clock generator 37, a single counter 38, a single falling differentiator, a single latch 44, a single delay circuit 45, and a single data conversion table 46 in a time-divisional manner. If fret position detection is time-divisionally performed, the arrangement of the fret discriminating means can be simplified.

Figure 9:
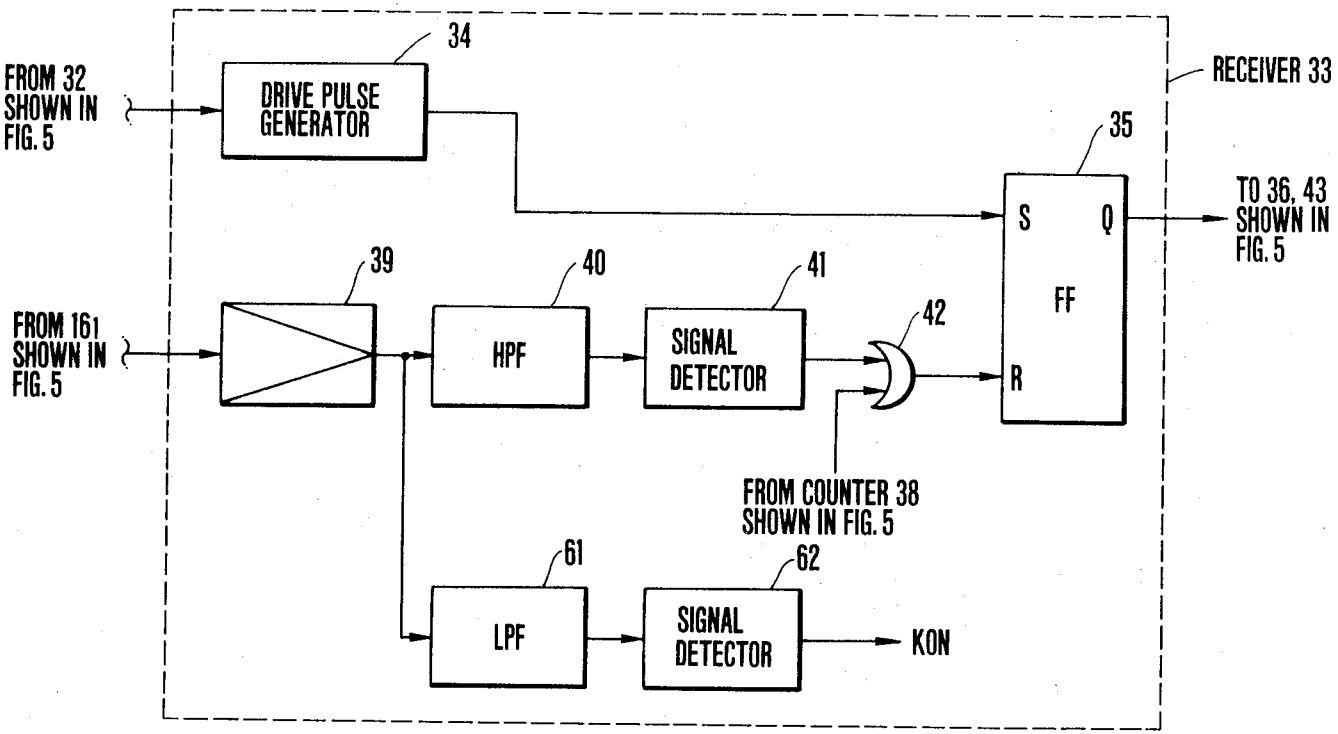
FIG. 9 is a block diagram showing a modification of the receiver in FIG. 5.

As shown in FIG. 9, the receiver 33 may be connected in parallel with the high-pass filter 40 and a low-pass filter (LPF) 61. A picking component may be extracted from the electrical signal S3 or separately from the signal S3. The picking component extracted by the low-pass filter 61 is supplied to the tone generator 47. The picking components are extracted from the electrical signals S3 from the piezoelectric elements $16_1$ to $16_6$ to obtain picking signals KON, thereby eliminating the electromagnetic pickups $21_1$ to $21_6$ and thus simplifying the construction.

In the electronic stringed instrument of FIG. 2, the picking timings are discriminated on the basis of the low-frequency vibrations detected by the electromagnetic pickups. The fret is discriminated according to the propagation time of the ultrasonic signal propagating in the string through the piezoelectric element. Two types of vibration detecting means (i.e., the piezoelectric element and the electromagnetic pickup) must be arranged in the instrument body, thus complicating the construction and increasing the manufacturing cost of the electronic stringed instrument.

Figure 10:
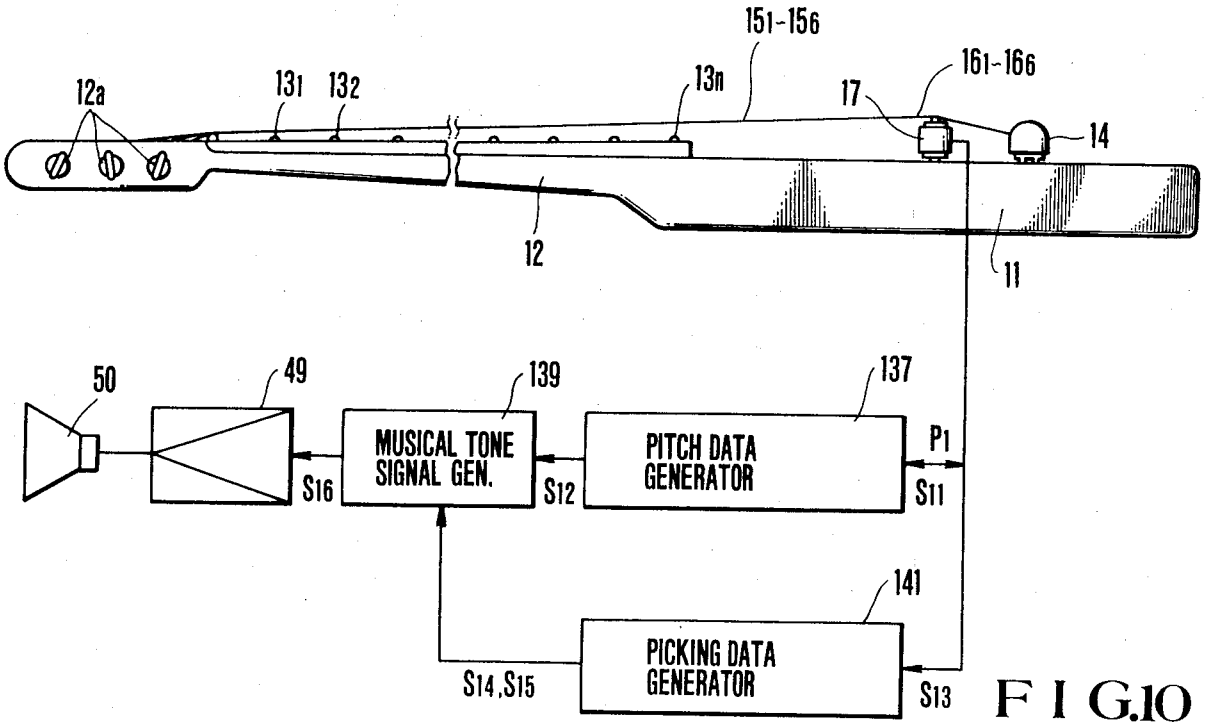
FIG. 10 is a side view showing a stringed instrument according to another embodiment of the present invention.
Figure 11:
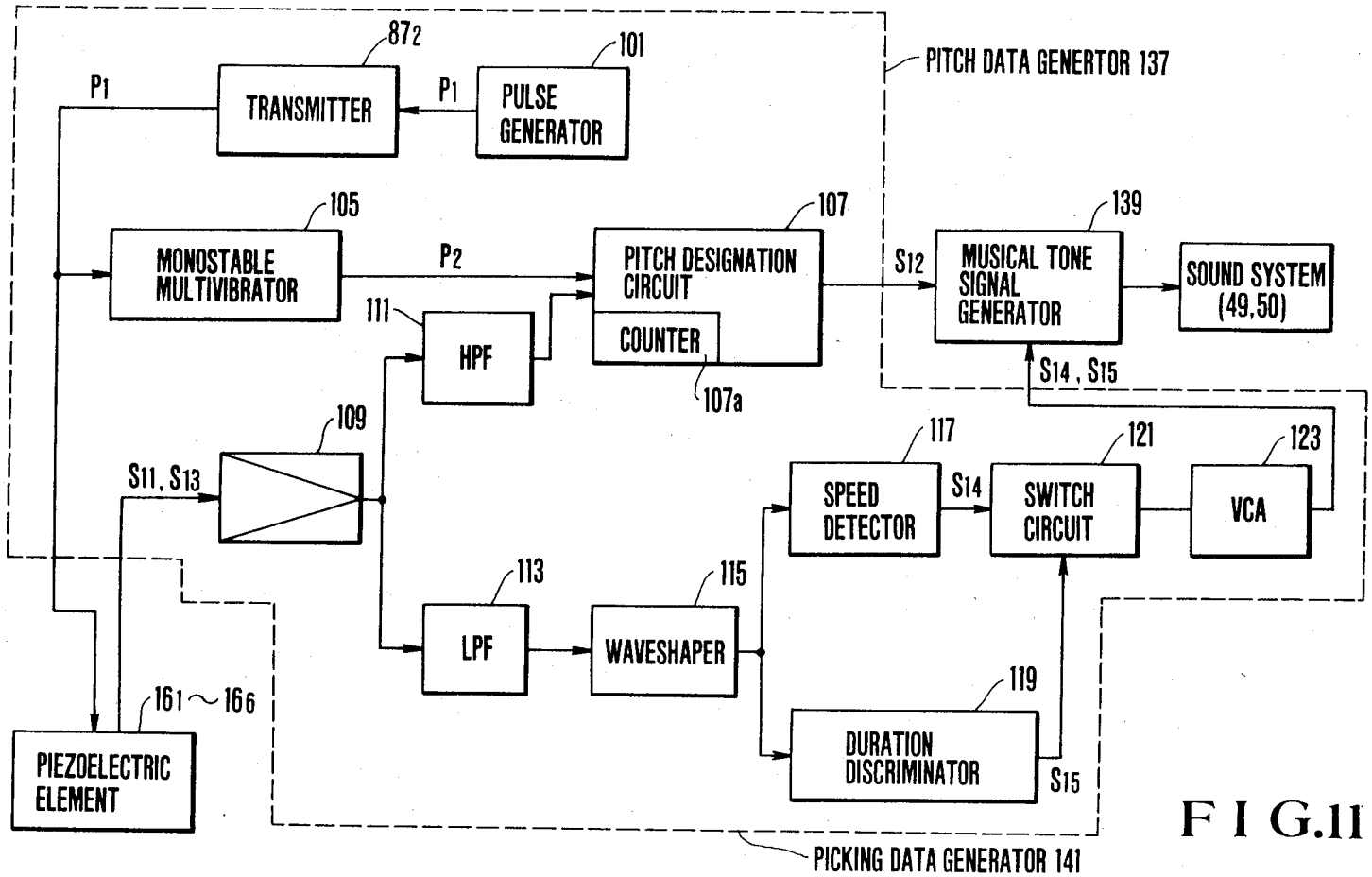
FIG. 11 is a block diagram of the stringed instrument in FIG. 10.

In order to solve the problem described above, a single detecting means is provided for detecting the picking timing and discriminating the fret contacting the picked string, as shown in FIGS. 10 to 12.

Another embodiment of the present invention will be described with reference to FIGS. 10 to 12G. The same reference numerals as in FIG. 2 denote the same parts and functions in FIG. 10 to 12G. Referring to FIGS. 10 to 12G, an instrument body 11, tuning keys 12*a*, a tailpiece 14, six strings $15_1$ to $15_6$ having different diameters and kept taut between the tuning keys 12*a* and the tailpiece 14, n frets $13_1$ *to* $13_n$ fixed on a neck 12 of the body 1 in a direction substantially perpendicular to the strings $15_1$ to $15_6$, and a bridge holder 17 extending on the body 11 at the tailpiece 14 side and having ceramic piezoelectric elements $16_1$ to $16_6$ corresponding to the strings $15_1$ to $15_6$ are substantially the same as those of FIG. 2. The piezoelectric elements $16_1$ to $16_6$ are in direct contact with the strings $15_1$ to $15_6$, respectively. The piezoelectric elements $16_1$ to $16_6$ generate ultrasonic signals in response to drive pulses P1 as a first electric signal supplied from a pitch data generating means 137 and transmit the ultrasonic signals to the corresponding strings $15_1$ to $15_6$. The ultrasonic signals transmitted to the strings $15_1$ to $15_6$ propagate toward the frets $13_1$ to $13_n$ through the strings $15_1$ to $15_6$. The ultrasonic signals are reflected by the frets contacting the corresponding strings, so that the corresponding echoes are generated. The echoes propagate back to the piezoelectric elements through the strings and are converted by the piezoelectric elements into reflection signals S11 as a second electrical signal.

Each reflection signal S11 is supplied to the pitch data generating means 137. The pitch data generating means 137 counts the time interval between the sending timing of the drive pulse P1 and the reception timing of the reflection signal S11. The frets which caused generation of the echoes are discriminated according to the count results. The frets discriminated by the echoes represent pitches of the desired musical tones. The pitch data generating means 137 generates a pitch signal S12 representing the pitch of the tone to be produced. The pitch signal S12 is supplied to a musical tone signal generator 139.

When the player wishes to produce one or more musical tones and depresses one or more strings $15_1$ to $15_6$, the picked strings are vibrated at low frequencies. The low-frequency vibrations are converted into low-frequency picking signals S13 as third electrical signals by the corresponding ones of the piezoelectric elements $16_1$ to $16_6$. Each picking signal S13 is detected by a picking data generating means 141. The picking data generating means 141 supplies a volume signal S14 representing a musical tone volume and a duration signal S15 representing the duration of the musical tone according to the picking signal S13 to the musical tone signal generator 139. As a result, the musical tone generator 139 generates a musical tone signal S16 according to the pitch signal S2, the volume signal S14, and the duration signal S15. The musical tone signal S16 is supplied to a sound system including an amplifier 49 and a loudspeaker 50, thereby producing a musical tone.

Figures 12A, 12B, 12C, 12D, 12E, 12F, 12G:
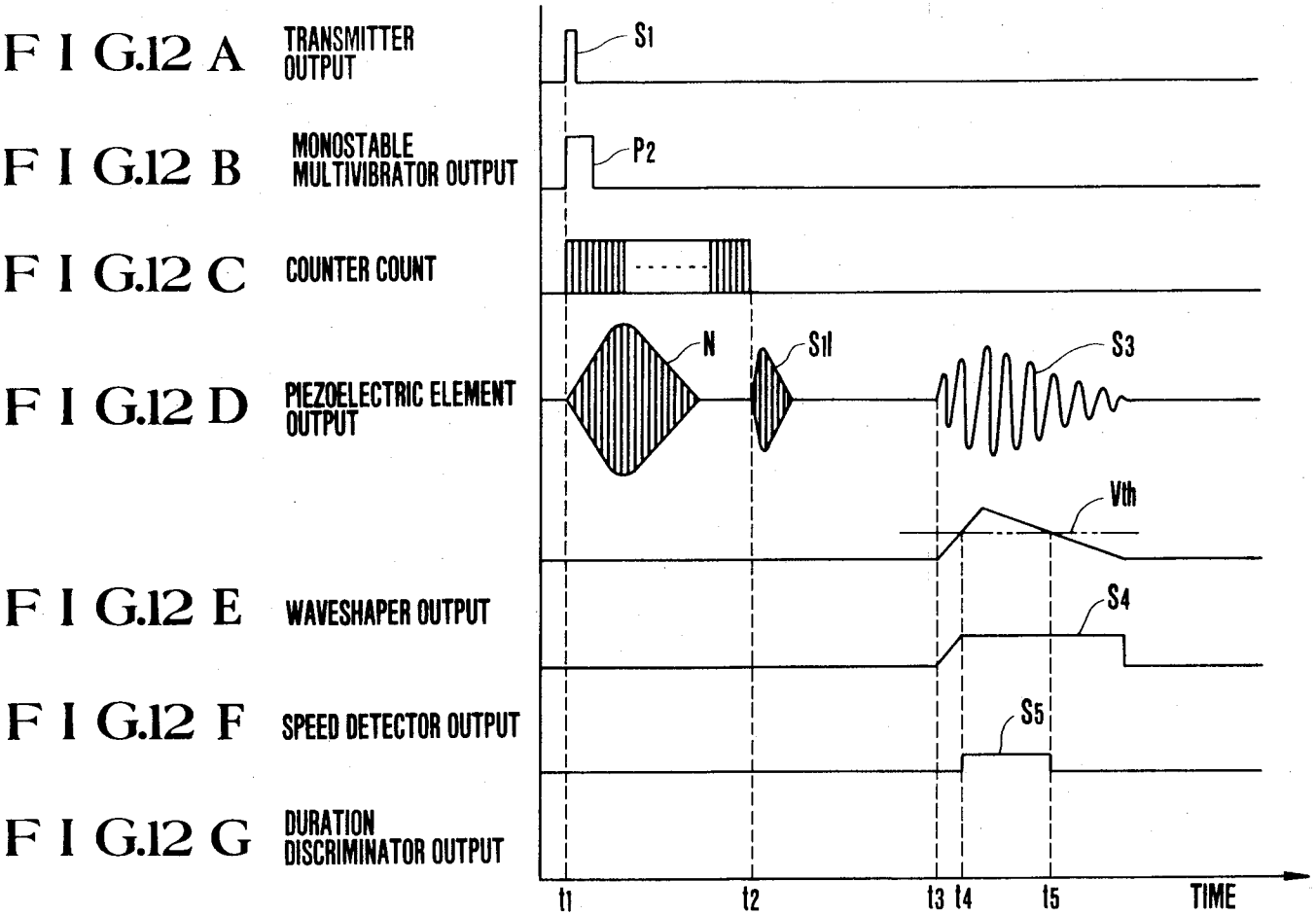
FIGS. 12A to 12G are timing charts for explaining the operation of the stringed instrument in FIG. 10.

The detailed arrangements and operations of the pitch data generating means 137 and the picking data generating mean 141 will be described with reference to FIGS. 11 to 12G. Although the circuit in FIG. 11 is arranged for each one of the piezoelectric elements $16_1$ to $16_6$, the circuit arranged for the piezoelectric element $16_1$ is exemplified in the following description. Referring to FIG. 11, reference numeral 101 denotes a pulse generator for generating a drive pulse P1. When the drive pulse P1 is supplied from the pulse generator 101 to the piezoelectric element $16_1$ and a monostable multivibrator 105 through a transmitter 103 (FIG. 12A), the piezoelectric element $16_1$ generates an ultrasonic wave in response to the drive pulse P1, and the ultrasonic wave is transmitted to the string $15_1$ (N in FIG. 12D represents self-excited noise of the piezoelectric element $16_1$) The ultrasonic wave transmitted to the string $15_1$ propagates through the string $15_1$ toward the frets $13_n$, . . . $13_1$. The ultrasonic wave is reflected by one of the frets $13_1$ to $13_n$ which is in contact with the string $15_1$, and the corresponding echo is generated. The echo propagates back through the string $15_1$ toward the piezoelectric element $16_1$.

The monostable multivibrator 105 generates a one-shot pulse P2 in response to the drive pulse P1. The one-shot pulse P2 is supplied to a pitch designation circuit 107 (FIG. 12B). The pitch designation circuit 107 causes its built-in counter 107*a* to count clocks in response to the one-shot pulse P2 (FIG. 12C). When the echo reaches the piezoelectric element $15_1$ at time t2, the piezoelectric element $15_1$ generates the reflection signal S11 derived from the echo (FIG. 12D). The reflection signal S11 is amplified by an amplifier 109, and the amplified signal is supplied to a high-pass filter 111 and a low-pass filter 113. Since the reflection signal S11 is generated on the basis of the echo of the ultrasonic signal, its frequency is very high. Therefore, the reflection signal S11 passes through only the high-pass filter 111, and the filtered signal is supplied to the pitch designation circuit 107. The counter 107*a* in the pitch designation circuit 107 stops counting the clocks, and the current count is held thereby (FIG. 12C). The count corresponds to a time interval between the sending timing of the drive pulse P1 and the reception timing of the reflection signal S11, thereby representing the fret which generated the echo. The pitch designation circuit 107 supplies the pitch signal S2 representing the pitch of the musical tone to the musical tone generator 139 according to the count.

When the player picks the string $15_1$ to produce a desired musical tone after the pitch of the musical tone to be produced is determined, the string $15_1$ is vibrated at a low frequency. The string vibrations are converted into the low-frequency picking signal S13 by the piezoelectric element $16_1$ at time t3 (FIG. 12D). The picking signal S13 is amplified by an amplifier 109, and the amplified signal is filtered through only a low-pass filter 113. The filtered signal is then supplied to a waveshaper 115. The waveshaper 115 extracts an envelope of the picking signal S13 (FIG. 12E). A speed detector 117 in the next stage holds a peak value obtained after a lapse of a predetermined period of time. The volume signal S14 is formed according to the value (FIG. 12F). In general, if the string is strongly picked, the amplitude of the picked string is increased. The peak value obtained after the lapse of the predetermined period of time is proportional to the picking strength and to the volume level of the musical tone. An output from the waveshaper 115 is also supplied to a duration discriminator 119 so that the peak value is compared with a threshold value Vth. If the output from the waveshaper 115 exceeds the threshold value Vth at time t4, the duration signal S5 output from the duration discriminator 119 goes high. When the output from the waveshaper 115 is lower than the threshold value Vth at time t5, the duration signal S5 goes low (FIG. 12G).

While the duration signal S15 is kept high, a switch circuit 121 is turned on and then the volume signal S14 is supplied to a voltage-controlled amplifier (VCA) 123. The musical tone generator 139 receives the output from the amplifier 123 and the pitch signal S12 and generates a musical tone signal having predetermined pitch and volume levels. The musical tone signal is supplied to the sound system.

In the electronic stringed instrument of this embodiment, the piezoelectric elements $16_1$ to $16_6$ can be used to generate the reflection signal S11 and the picking signal S13, thereby simplifying the overall construction and reducing the manufacturing cost.

In the above embodiment, the volume signal S14 and the duration signal S15 are generated by the picking data generating means 141. However, the present invention is not limited to these signals. For example, a signal associated with other string picking may be generated.

In the embodiment of FIG. 10, the material and structure of the strings are selected to minimize attenuation of the ultrasonic signals propagating through the string. However, the echo of the ultrasonic signal generated in response to the drive pulse P1 applied to the piezoelectric element is not greatly attenuated, but converted into the electrical signal E1 by the piezoelectric element. The signal E1 is used to discriminate the fret which has generated the echo. However, with this arrangement, while the echo propagates through the string, a secondary echo is generated, and then noise N2 is generated on the basis of the second echo. Furthermore, noise N3 is generated on the basis of the ternary echo. The secondary and subsequent echoes are not normally greatly attenuated. It is difficult to discriminate the electrical signal E1 from the noise N2 or N3. In order to accurately discriminate the fret which has generated the echo, the pulse interval must be increased.

Figure 13:
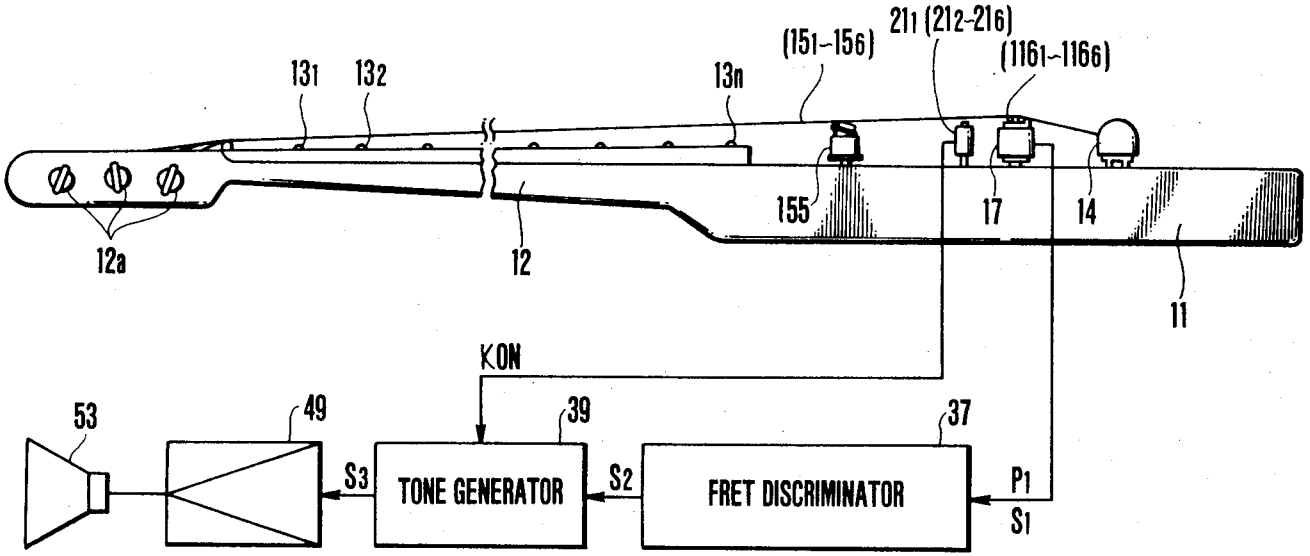
FIG. 13 is a side view showing a stringed instrument according to still another embodiment of the present invention.
Figure 14:
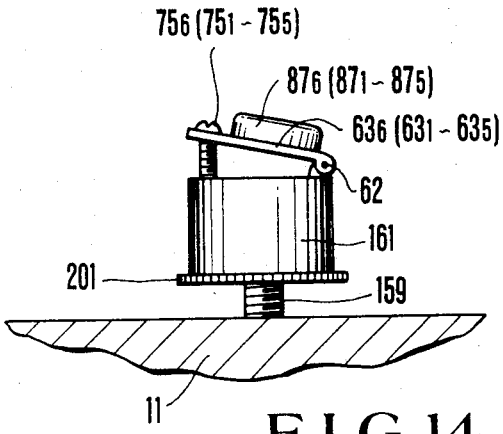
FIG. 14 is a side view showing a damping means in the stringed instrument in FIG. 13.
Figure 15:
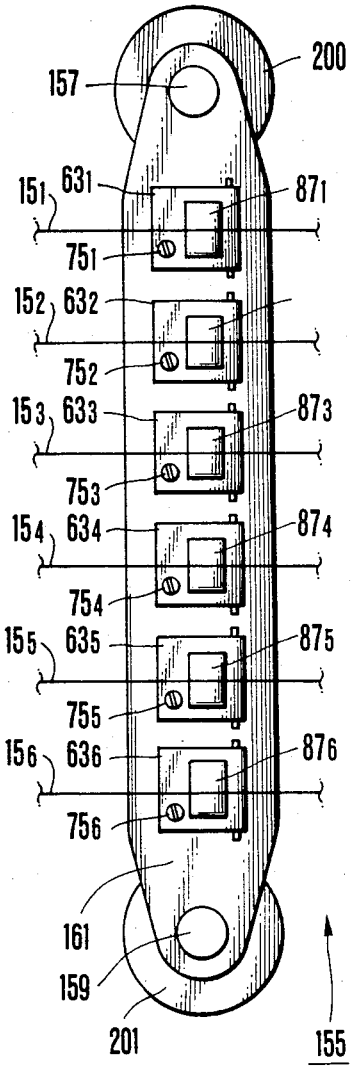
FIG. 15 is a plan view showing the damping means in FIG. 15.

FIGS. 13 to 15 show still another embodiment for solving the above problem. The same reference numerals as in FIGS. 2 to 4 denote the same parts and functions in FIGS. 13 to 15. Referring to FIGS. 13 to 15, six strings $15_1$ to $15_6$ having different diameters are kept tout on an instrument body 11 between tuning keys 12*a* and a tailpiece 14. N frets $13_1$ to $13_n$ are fixed on a neck 12 of the body 11 in a direction substantially perpendicular to the strings $15_1$ to $15_6$. The strings $15_1$ to $15_6$ can be brought into contact with these frets. A bridge holder 17 is fixed on the body 11 at the tailpiece 14 side. The bridge holder 17 supports six ceramic piezoelectric elements $116_1$ to $116_6$ as the piezoelectric transducer means. The piezoelectric elements $116_1$ to $116_6$ are in direct contact with the strings $15_1$ to $15_6$, respectively. The piezoelectric elements $116_1$ to $116_6$ can generate ultrasonic vibrations in response to drive pulses P1 as a first electric signal supplied from a fret discriminator 37. The ultrasonic vibrations are transmitted to the corresponding strings $15_1$ to $15_6$. The ultrasonic vibrations propagate as ultrasonic signals through the strings $15_1$ to $15_6$ toward the frets $13_n$ to $13_1$. The ultrasonic signals are reflected at positions where frets are in contact with the corresponding strings, so that the corresponding echoes are generated. The echoes propagate back to the piezoelectric elements $116_1$ to $116_6$ through the strings $15_1$ to $15_6$. The echoes are converted into reflection signals S1 as second electrical signals by the piezoelectric elements $116_1$ to $116_6$. Each reflection signal S1 is supplied to the fret discriminator 37. The fret discriminator 37 counts a time interval between a sending timing of the drive pulse P1 and a reception timing of the reflection signal S1, thereby discriminating each fret contacting the corresponding string. The frets $13_1$ to $13_n$ which generate the echoes represent pitches of the desired musical tones. The fret discriminator 37 generates a pitch signal S2 representing a pitch of a tone to be produced, according to the fret position discrimination result. The pitch signal S2 is sent to a tone generator 39.

When the player wishes desired musical tones and picks the strings $15_1$ to $15_6$, the strings $15_1$ to $15_6$ are vibrated at low frequencies. The low-frequency vibrations are picked up by electromagnetic pickups $21_1$ to $21_6$ respectively arranged for the strings $15_1$ to $15_6$. Picking signals KON based on the detection results are supplied to the tone generator 39. In response to each picking signal KON, the tone generator 39 generates a musical tone signal S3 according to the pitch signal S2. The musical tone signal S3 is generated to the sound system including an amplifier 49 and a loudspeaker 53. Therefore, a musical tone is produced.

The arrangement of a damping means 155 will be described. The damping means 155 is fixed on the body 11 near the electromagnetic pickups $21_1$ to $21_6$. The detailed arrangement of the damping means is illustrated in FIGS. 14 and 15. A pair of studs 157 and 159 extending on the body 11 are slidably fitted at both ends of a support member 161. Six plate members $63_1$ to $63_6$ respectively corresponding to the strings $15_1$ to $15_6$ are disposed on the upper surface of the support member $16_1$. One end of each of the plate members $63_1$ to $63_6$ is coupled by a pin 62 to the support member 161. The other end of each of the plate members $63_1$ to $63_6$ is threadably engaged with a corresponding one of screws $75_1$ to $75_6$. When the screws $75_1$ to $75_6$ are threadably fitted in the plate members $63_1$ to $63_6$, respectively, the other end (the end spaced apart from the corresponding pin 62) of each of the plate members $63_1$ to $63_6$ comes near a corresponding one of the strings $15_1$ to $15_6$. Dampers $87_1$ to $87_6$ are adhered to the centers of the plate members $63_1$ to $63_6$, respectively. When the other end of each of the plate members $63_1$ to $63_6$ comes near the corresponding one of the strings $15_1$ to $15_6$, the dampers $87_1$ to $87_6$ are brought into contact with the strings $15_1$ to $15_6$. As a result, the support member 161 is urged downward (FIG. 14) by the elastic forces of the strings $15_1$ to $15_6$. However, the downward movement of the support member 161 is defined by nuts 200 and 201 threadably engaged with the studs 157 and 159. Although the dampers $87_1$ to $87_6$ can damp the propagating ultrasonic signal or the primary echo or an echo of higher order generated by contact between the string and any one of the frets $13_1$ to $13_n$ at a predetermined ratio, the dampers cannot damp the primary echo which causes the piezoelectric elements $116_1$ to $116_6$ to disable generation of the reflection signals S1. The contact state between the dampers $87_1$ to $87_6$ and the strings $15_1$ to $15_6$ can be adjusted, and thus the above damping ratio can be adjusted.

Figure 16:
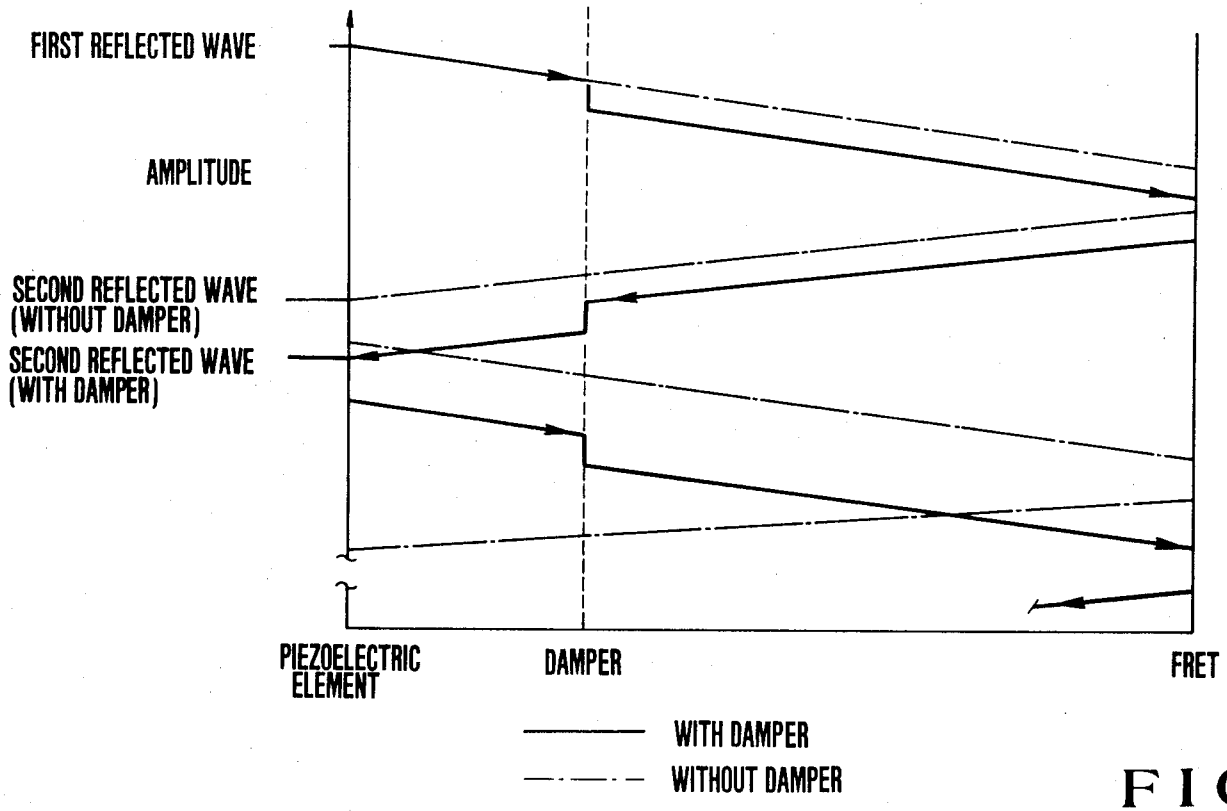
FIG. 16 is a graph for explaining attenuation of ultrasonic vibrations.

The operation of the damping means 155 will be described with reference to FIG. 16. FIG. 16 is a graph showing the attenuation state of the ultrasonic vibrations. The ultrasonic vibrations generated by the piezoelectric elements $116_1$ to $116_6$ are transmitted as ultrasonic signals to the strings $15_1$ to $15_6$ and propagate through the strings $15_1$ to $15_6$ toward the frets $13_n$ to $13_1$. The ultrasonic signals are damped by the damping means 155 at a predetermined ratio. Each damped ultrasonic signal is then reflected by one of the frets $13_1$ to $13_n$ to generate a primary echo. The primary echo is damped again by the damping means 155 before it reaches the corresponding one of the piezoelectric elements $116_1$ to $116_6$. Therefore, the ultrasonic vibrations are damped by the damping means 155 twice while they reciprocate between the piezoelectric elements $116_1$ to $116_6$ and the frets $13_1$ to $13_n$, thereby reducing the amplitudes of the ultrasonic vibrations. The decreases in amplitudes occur in the secondary echo and the subsequent echoes of higher orders based on the primary echo. The difference between the amplitudes of the ultrasonic signal and the echo becomes typical when the order of echoes is increased. As a result, the fret discriminator 37 can easily discriminate the reflection signal S1 based on the primary echo from undesirable noise. Therefore, the fret which caused generation of the echo can be accurately discriminated. Since the echoes of higher orders are rapidly damped, the interval of the drive pulses P1 can be shortened. Therefore, the resolution of the fret position discrimination can be improved.

The above embodiment exemplifies an electronic stringed instrument using piezoelectric elements for ultrasonic transmission and reception. However, the present invention is applicable to an electronic musical instrument wherein transmitting piezoelectric elements are arranged in units of frets, and the ultrasonic signals transmitted from the transmitting piezoelectric elements to the strings are received by receiving piezoelectric elements so as to convert the echoes into electrical signals.

Figure 17:
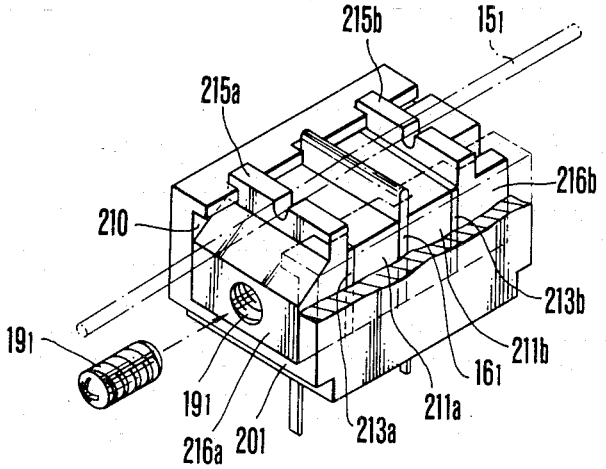
FIG. 17 is a perspective view showing a modification the piezoelectric element according to the present invention.

The present invention is not limited to the particular embodiments described above. Various changes and modifications may be made within the spirit and scope of the invention. A piezoelectric element mounted on a bridge may be arranged, as shown in FIG. 17. Referring to FIG. 17, a bridge $20_1$ having a piezoelectric element $16_1$ will be exemplified. The bridge $20_1$ has a substantially C-shaped groove 210 open upward from one of the side walls thereof in the direction toward which a screw $20_1$ is threadably engaged. A plate-like piezoelectric element $16_1$ having a rectangular section is disposed at the center of the groove 210. Conductive rubber members **211*a* and 211*b* are located in contact with both ends of the piezoelectric element $16_1$. Leaf electrodes 213*a* and 213*b* are arranged in contact with the rubber members 211*a* and 211*b*, respectively. String seat members 216*a* and 216*b* are disposed outside the leaf electrodes 213*a* and 213*b*. The string seat members 216*a* and 216*b* have string seats 215*a* and 215*b* for receiving the string $15_1$ and tightly hold the piezoelectric element $16_1$, the rubber members 211*a* and 211*b*, and the leaf electrodes 213*a* and 213*b* so as to constitute an integral body. In this case, the legs of the leaf electrodes 213*a* and 213*b* extend downward through the holes formed in the bottom of the bridge $20_1$ and are connected to a printed circuit board (not shown) disposed along the lower surface of the bridge holder. The lower surfaces of the rubber member 211*a*, the piezoelectric element $16_1$, and the rubber member 211*b* are placed on a projection extending on the bottom of the bridge $20_1$. The respective components are in contact with a screw extending from the lower surface side of the bridge holder through the holes of the bridge holder and the bridge and are fixed in position on the projection. Upon energization of the leaf electrodes 213*a* and 213*b* to drive the piezoelectric element, the vibrations are transmitted to the string seat members 216*a* and 216*b* through the rubber members 211*a* and 211*b*, and the electrodes 213*a* and 213*b*. Ultrasonic vibrations are transferred from the string seats 215*a* and 215*b*** to the string $15_1$. The ultrasonic vibrations are reflected by the fret to generate an echo. The echo is transmitted to the piezoelectric element $16_1$ in the reverse order and is converted into an electrical signal.

What is claimed is:

1. An electronic stringed instrument comprising:

an instrument body;

a string which is stretched above said instrument body;

a plurality of metal frets which are provided on said instrument body and below said string so that a player's depression of said string causes contact between said string and one or ones of said plurality of metal frets;

ultrasonic transmitting/receiving means, provided on said instrument body and coupled to a specific point of said string, for generating an ultrasonic wave so that said ultrasonic wave is propagated through said string toward the nearest fret to said specific point among the fret or frets contacting said string and for receiving an echo wave which is a reflected wave of said ultrasonic wave from said nearest fret; and fret discriminating means connected to said ultrasonic transmitting/receiving means for discriminating said nearest fret among said plurality of metal frets according to a time difference between generation of said ultrasonic wave and the receipt of said echo wave and for generating a fret signal representing said nearest fret.

2. An electronic stringed instrument according to claim 1, further comprising:

vibration detecting means, disposed between said ultrasonic transmitting/receiving means and the nearest fret to said ultrasonic transmitting/receiving means among said plurality of metal frets, for detecting vibration of said string produced by the player's picking of said string and for generating a detection signal based on the detected vibration.

3. An electronic stringed instrument according to claim 2, further comprising a tone generator connected to said vibration detection means for generating a tone signal in response to said detection signal.

4. An electronic stringed instrument according to claim 1, wherein said ultrasonic transmitting/receiving means for converting a vibration of said string to a vibration signal, said vibration comprising echo vibration produced by said echo wave and picking vibration produced by the player's picking of said string.

5. An electronic stringed instrument according to claim 4, further comprising vibration detection means connected to said ultrasonic transmitting/receiving means, said vibration detection means comprising a low-pass filter for receiving said vibration signal and for taking out a component only of said picking vibration.

6. An electronic stringed instrument according to claim 4, wherein said fret discriminating means comprises a high-pass filter for receiving said vibration signal and for taking out a component of said picking vibration.

7. An electronic stringed instrument according to claim 1, further comprising a damper for damping ultrasonic vibrations propagating through said strings at a predetermined ratio.

8. An electronic stringed instrument according to claim 1, wherein said ultrasonic transmitting/receiving means further comprises:

a bridge holder mounted on said instrument body;

bridges mounted on said bridge holder and movable parallel to said strings; and a transmitter/receiver, constituting part of said ultrasonic transmitting/receiving means and mounted on each of said bridges, for transmitting and receiving the ultrasonic wave.

9. An electronic stringed instrument according to claim 8, wherein said transmitter/receiver comprises a piezoelectric element.

10. An electronic stringed instrument according to claim 8, wherein said bridge comprises said piezoelectric element, conductive rubber members disposed in tight contact with both sides of said piezoelectric element, and leaf electrodes disposed in tight contact with both ends of said conductive rubber members.

11. An electronic stringed instrument comprising:

an instrument body;

a string which is stretched above said instrument body;

a plurality of frets fixed on said instrument body and below said string so that a player's depression of said string causes contact between said string and one or ones of said plurality of frets;

converting means provided on said instrument body and coupled to a specific point of said string for causing ultrasonic vibration of said string in response to a first signal and for converting echo vibration produced by a reflection of said ultrasonic vibration from the nearest fret to said specific point among the fret or frets contacting said string to a second electrical signal;

fret discriminating means connected to said converting means for discriminating said nearest fret among said plurality of frets on the basis of said first and second electrical signals and for outputting a fret signal representing said nearest fret; and damping means for damping the ultrasonic vibration of said string at a predetermined ratio so that further echo vibration produced by a reflection of said echo vibration from said nearest fret can be substantially eliminated.

12. An electronic stringed instrument comprising:

an instrument body;

a string which is stretched above said instrument body;

a plurality of frets which are provided on said instrument body and below said string so that a player's depression of said string causes contact between said string and one or ones of said plurality of frets;

a piezoelectric transducer element provided on said instrument body and coupled to a specific point of said string for causing ultrasonic vibration of said string in response to a first electrical signal, and for generating a second electrical signal on the basis of echo vibration produced by a reflection of said ultrasonic vibration from the nearest fret to said specific portion among the fret or frets contacting said string, and a third electrical signal on the basis of string vibrations upon the player's picking of said string;

fret discriminating means for generating a fret signal representing a pitch corresponding to said nearest fret on the basis of said first and second electrical signals; and picking data generating means for generating picking data relating to said player's picking in accordance with said third electrical signal.

13. An electronic stringed instrument according to claims 4 or 5, wherein said instrument body comprises a body portion, a neck portion and a head portion, said neck portion being between said head portion and said body portion; and said string is stretched between said body portion and said head portion.

14. An electronic stringed instrument according to claim 13, further comprising a tail piece fitted on said body portion for fixing one end of said string; and a damper disposed between said ultrasonic transmitting-/receiving means on said body portion for damping a vibration of said string produced by the player's picking of said string.

15. An electronic stringed instrument according to claim 13, further comprising a tuning key provided on said head portion for fixing one end of said string; and a damper disposed between said tuning key and the nearest fret to said head portion for damping a vibration of said string produced by the player's picking of said string.

16. An electronic stringed instrument according to claim 13, wherein said plurality of metal frets are arranged on said neck portion in a line.

17. An electronic stringed instrument according to claims 4 or 5, further comprising a tone generator connected said fret discriminating means for generating a tone signal having a pitch determined by said fret signal.

18. An electronic stringed instrument according to claim 12, wherein the picking data includes data representing a strength of said player's picking.

19. An electronic stringed instrument according to claim 12, wherein the picking data includes data representing timing of said player's picking.

* * * * *